US011075461B2

(12) United States Patent
Leung et al.

(10) Patent No.: US 11,075,461 B2
(45) Date of Patent: Jul. 27, 2021

(54) HORN ANTENNA

(71) Applicant: City University of Hong Kong, Kowloon (HK)

(72) Inventors: Kwok Wa Leung, Kowloon Tong (HK); Kai Lu, Shatin (HK); Nan Yang, Sham Shui Po (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 16/714,982

(22) Filed: Dec. 16, 2019

(65) Prior Publication Data

US 2021/0184359 A1 Jun. 17, 2021

(51) Int. Cl.
*H01Q 13/02* (2006.01)

(52) U.S. Cl.
CPC ..... *H01Q 13/0241* (2013.01); *H01Q 13/0283* (2013.01)

(58) Field of Classification Search
CPC . H01Q 13/02; H01Q 13/0241; H01Q 13/0283
See application file for complete search history.

(56) References Cited

U.S. PATENT DOCUMENTS

| | | | | |
|---|---|---|---|---|
| 3,458,862 | A | 7/1969 | Franks | |
| 4,353,072 | A | 10/1982 | Monser | |
| 5,359,339 | A | 10/1994 | Agrawal et al. | |
| 6,489,931 | B2 | 12/2002 | Liu | |
| 6,995,728 | B2 | 2/2006 | Rodriguez | |
| 7,161,550 | B2 * | 1/2007 | McLean | H01Q 13/0275 343/786 |
| 8,248,321 | B2 | 8/2012 | Anderson | |
| 10,218,076 | B1 * | 2/2019 | Bhardwaj | H01Q 13/0225 |
| 2019/0291186 | A1 * | 9/2019 | Aston | H01Q 19/108 |

* cited by examiner

*Primary Examiner* — Hoang V Nguyen
(74) *Attorney, Agent, or Firm* — Renner Kenner Greive Bobak Taylor & Weber

(57) ABSTRACT

A horn antenna includes a waveguide portion and an antenna portion operably connected with the waveguide portion. The waveguide portion has a feed port. The antenna portion is arranged to receive a linearly polarized signal from the waveguide portion and to convert the received linearly polarized signal to a circularly polarized signal for transmission.

17 Claims, 11 Drawing Sheets

Normalized Patterns (dB)

10GHz

HORN ANTENNA

TECHNICAL FIELD

The invention relates to a horn antenna and particularly, although not exclusively, to a circularly polarized horn antenna.

BACKGROUND

Horn antennas are known and have been used in communication applications such as satellite communication, radar, and radio astronomy. Generally speaking, horn antennas can be classified, based on polarization, into two types, namely, linearly polarized horn antennas and circularly polarized horn antennas.

One common way of forming a circularly polarized horn antenna is to couple a separate linear-polarization-to-circular-polarization converter or adapter to an existing linearly polarized horn antenna. The converter or adapter may be an inhomogeneous solid structure or a birefringent aperture polarizer, each having their own merits and drawbacks. The inhomogeneous solid structure can provide a relatively wide band but is rather bulky. The birefringent aperture polarizer is light and can be easily mounted but provides a relatively narrow bandwidth.

SUMMARY OF THE INVENTION

It is an object of the invention to address one or more of the above needs, to overcome or substantially ameliorate one or more of the above disadvantages or, more generally, to provide an improved or alterative horn antenna.

In accordance with a first aspect of the invention, there is provided a horn antenna having a waveguide portion and an antenna portion operably connected with the waveguide portion. The waveguide portion has a feed port. The antenna portion is arranged to receive a linearly polarized signal from the waveguide portion and to convert the received linearly polarized signal to a circularly polarized signal for transmission, e.g., to an environment. In this configuration the feed port may be connected with a signal source. The antenna portion avoids the need hence use of external orthogonal excitation sources or an additional external polarizer.

In one embodiment of the first aspect, the antenna portion is further arranged to convert a circularly polarized signal received (e.g., from the environment) to a linearly polarized signal and to transmit the linearly polarized signal to the waveguide portion. In this configuration the feed portion may be connected with an external signal receiver.

The horn antenna may be a transmit antenna, a receive antenna, or a transceiver antenna. The horn antenna may operate as a transmit antenna, a receive antenna, or a transceiver antenna.

In one embodiment of the first aspect, the antenna portion includes a transition portion for modulating the linearly polarized signal received from the waveguide portion. The modulation facilitates smooth transition of signals between the waveguide portion and the antenna portion.

In one embodiment of the first aspect, the feed port is the only feed port of the horn antenna such that the horn antenna is a single-feed horn antenna. The feed port may be a co-axial feed or probe.

In one embodiment of the first aspect, the antenna portion and the waveguide portion are unitary, and preferably, integrally formed.

In one embodiment of the first aspect, the antenna portion and the waveguide portion are metallic. The metallic material may be aluminium-alloy. The use of metal improves radiation efficiency.

The antenna portion may be an additively manufactured antenna. For example, the antenna portion may be 3D printed using a 3D printer. The waveguide portion maybe an additively manufactured waveguide. For example, the waveguide portion may be 3D printed using a 3D printer. The antenna portion and the waveguide portion maybe additively manufactured together, e.g., 3D printed using a 3D printer.

In one embodiment of the first aspect, the horn antenna is adapted for operation at least in the X-Band (generally covers 8 GHz to 12 GHz).

In one embodiment of the first aspect, the horn antenna includes a body defining the waveguide portion and the antenna portion. The body has an elongated housing extending generally along a longitudinal axis. The body also has one or more ridges arranged on and extending along an inner surface of the elongated housing.

In one embodiment of the first aspect, the elongated housing includes a non-flared housing part that belongs to the waveguide portion and a flared housing part that belongs to the antenna portion. The flared housing part tapers to widen away from the non-flared housing part.

The non-flared housing part may be generally cylindrical and the flared housing part may be generally frustoconical. Alternatively, the non-flared housing part may be generally pyramidal and the flared housing part may be generally frusto-pyramidal.

In one embodiment of the first aspect, each of the one or more ridges includes a first ridge part that belongs to the waveguide portion and a second ridge part that belongs to the antenna portion. The first and second ridge parts of each of the ridge are unitary or continuous.

In one embodiment of the first aspect, the elongated housing includes a non-flared housing part and a flared housing part and each of the one or more ridges include a first ridge part and a second ridge part. The first ridge part is arranged on and extended along an inner surface of the non-flared housing part. The second ridge part is arranged on and extended along an inner surface of the flared housing part. The non-flared housing part and the first ridge part of the one or more ridges form the waveguide portion (the waveguide portion may include other components). The flared housing part and the second ridge part of the one or more ridges form the antenna portion (the antenna portion may include other components). The flared housing part tapers to widen away from the non-flared housing part. The first and second ridge parts are unitary.

In one embodiment of the first aspect, the second ridge part includes a helical section for communicating a circularly polarized signal. The helical section may be a formed by at least one turn, preferably at least two turns, more preferably at least three turns. Since the helical section is mounted on the flared housing part, as the helical section extends along the inner surface of the flared housing part, the perimeter of the helical section generally increases away from the first ridge part.

In one embodiment of the first aspect, the first ridge part has a first thickness and the helical section has a second thickness smaller than the first thickness. This makes the horn antenna lighter (when compared with same thickness). The first thickness may be constant. The second thickness may be constant.

In one embodiment of the first aspect, the second ridge part further includes a transition section connected between the helical section and the waveguide portion. The transition section may be straight or slightly twisted.

In one embodiment of the first aspect, the one or more ridges include a plurality of ridges.

In one embodiment of the first aspect, a cross section of the antenna portion, e.g., when sectioned at where the helical sections locate, is rotationally symmetric. The rotational symmetry may be of order two when there are two ridges. The rotational symmetry may be of order three when there are three ridges. The rotational symmetry may be of order four when there are four ridges. The rotation symmetry provides a correspondingly symmetric radiation pattern and low cross polarization.

In one embodiment of the first aspect, the plurality of ridges includes a first ridge and a second ridge. The first ridge parts of the first ridge and the second ridge are arranged in parallel and opposite to each other. The separation between the first ridge parts of the first ridge and the second ridge is preferably constant.

In one embodiment of the first aspect, the plurality of ridges includes a first ridge and a second ridge, and the helical sections of the second ridge parts have generally the same pitch. The helical sections of the second ridge parts of the first and second ridges are arranged alternately.

The helical section(s) may turn clockwise. Alternatively, the helical section(s) may turn anti-clockwise. The helical sections of different ridges turn with the same sense (all clockwise or all anti-clockwise).

In accordance with a second aspect of the invention, there is provided an antenna array comprising a plurality of the horn antennas of the first aspect.

In accordance with a third aspect of the invention, there is provided a communication device comprising one or more of the horn antennas of the first aspect or the antenna array of the second aspect. The communication device may be used for satellite communication, radar, or radio astronomy.

In accordance with a fourth aspect of the invention, there is provided a computer program that, when executed by a 3D printer, creates the horn antenna of the first aspect or the antenna array of the second aspect.

In accordance with a fifth aspect of the invention, there is provided a computer model of the horn antenna of the first aspect or the antenna array of the second aspect.

The computer model may be a CAD drawing.

In accordance with a sixth aspect of the invention, there is provided a method of making the horn antenna of the first aspect or the antenna array of the second aspect. The method includes: creating a computer model of the horn antenna of the first aspect or the antenna array of the second aspect, processing the computer model using a 3D printer, and forming the horn antenna of the first aspect or the antenna array of the second aspect using the 3D printer. The computer model may be a CAD drawing.

In accordance with a seventh aspect of the invention, there is provided a 3D printer arranged to make the horn antenna of the first aspect or the antenna array of the second aspect. The 3D printer stores and processes a computer model of the horn antenna of the first aspect or the antenna array of the second aspect, then 3D prints the horn antenna of the first aspect or the antenna array of the second aspect.

In accordance with an eighth aspect of the invention, there is provided a horn antenna having an elongated housing extending generally along a longitudinal axis and one or more helical ridges arranged on and extending along an inner surface of the elongated housing. The elongated housing may be flared. The horn antenna in this eighth aspect may include one or more of the features of the first aspect.

In accordance with a ninth aspect of the invention, there is provided a horn antenna coupler, the coupler having an elongated housing extending generally along a longitudinal axis and one or more helical ridges arranged on and extending along an inner surface of the elongated housing. The elongated housing may be flared. The helical ridges may be arranged to connect with ridges of a linearly polarized horn antenna.

Words such that "generally", "about", "substantially", or the like, are, depending on context, used to take into account manufacture tolerance, which may be plus or minus 10%, degradation, trend, tendency, etc. As an example, expressions such as "generally increasing/decreasing" are taken to mean monotonically increasing/decreasing (need not strictly increasing/decreasing).

BRIEF DESCRIPTION OF THE DRAWINGS

Embodiments of the invention will now be described, by way of example, with reference to the accompanying drawings in which.

DETAILED DESCRIPTION

Figure 1B:
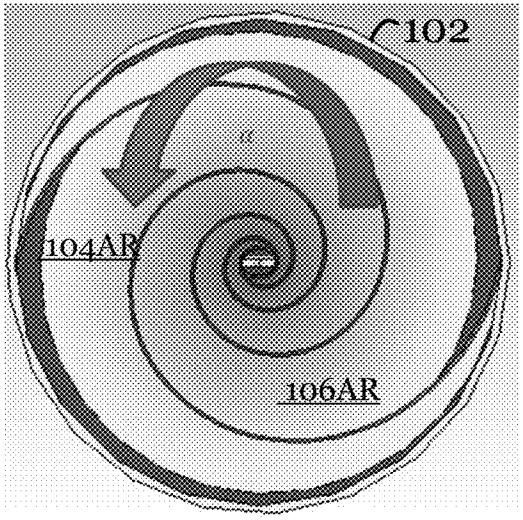
FIG. 1B is a front view of the horn antenna of FIG. 1A.
Figure 1A:
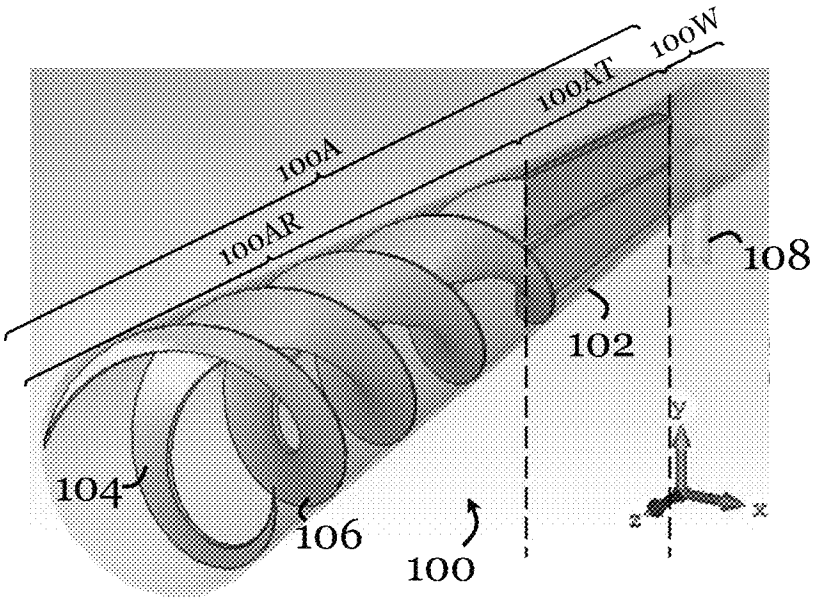
FIG. 1A is a perspective view of a horn antenna in one embodiment of the invention.

FIGS. 1A and 1B show a wideband circularly polarized horn antenna 100 in one embodiment of the invention. FIGS.

1C and 1D show an "untwisted" illustration of the horn antenna 100 to facilitate understanding of the various design parameters.

Referring to FIGS. 1A to 1D, the horn antenna 100 includes, generally, a waveguide portion 100W and an antenna portion 100A operably connected with the waveguide portion 100W. The waveguide portion 100W has a single feed port 108, which is the only feed port of the antenna 100. When the antenna 100 is used as a transmit antenna or a transceiver antenna in transmit mode, the feed port 108 can be connected with a signal source (not shown), and the antenna portion 100A is arranged to receive and convert a linearly polarized signal from the waveguide portion 100W to a circularly polarized signal for transmission to an environment. When the antenna 100 is used as a receive antenna or a transceiver antenna in receive mode, the feed port 108 can be connected with a load, a signal receiver, analyzer or the like (not shown) and the antenna portion 100A is arranged to receive and convert a linearly polarized signal from the environment to a circularly polarized signal for transmission to the waveguide portion 100W. The antenna portion 100A may have an intermediate transition portion 100AT for modulating signal transfer between the rest 100AR of the antenna portion 100A and the waveguide portion 100W. The antenna portion 100A and the waveguide portion 100W are integrally formed, e.g., using metallic material, using additive manufacturing method.

In this embodiment, the horn antenna 100 includes a body defining the waveguide portion 100W and the antenna portion 100A. The body has an elongated housing 102 extending generally along a longitudinal axis Z and two ridges 104, 106 arranged on and extending along an inner surface of the elongated housing 102.

Figures 1C, 1D:
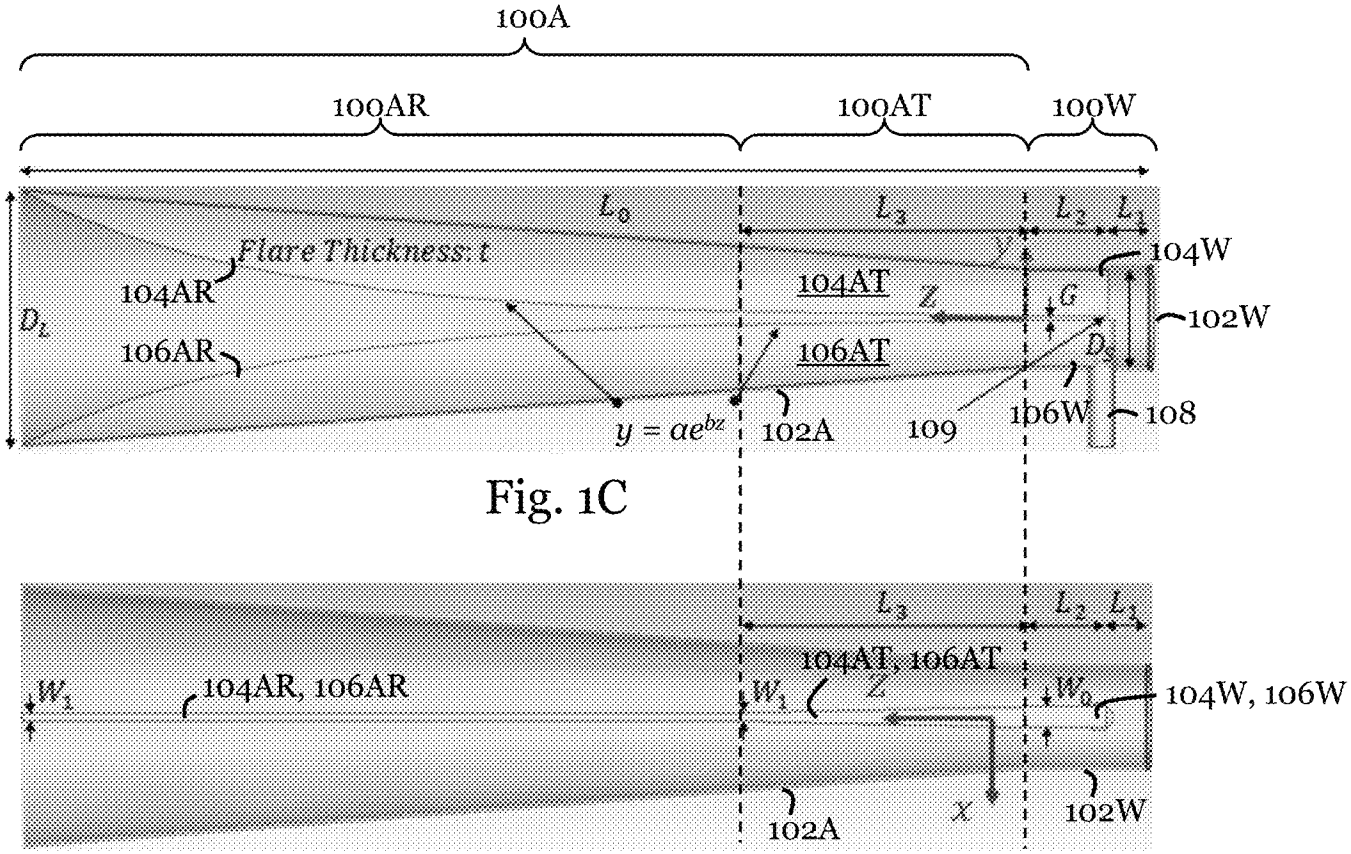
FIG. 1C is a side view of an "untwisted" illustration of the horn antenna of FIG. 1A.
FIG. 1D is a top view of an "untwisted" illustration of the horn antenna of FIG. 1A.

As shown in FIGS. 1A, 1C, and 1D, the housing 102 includes a generally cylindrical housing part 102W that is not flared and a frusto-conical flared housing part 102A connected with the generally cylindrical housing part 102W and tapered to widen away from the generally cylindrical housing part 102W. The tapering is generally linear.

Each of the two ridges 104, 106 includes a first ridge part 104W, 106W attached to the generally cylindrical housing part 102W and a second ridge part 104A, 106A attached to the frusto-conical flared housing part 102A. The first and second ridge parts 104W+104A or 106W+106A of the respective ridge 104, 106 are continuous. The first ridge parts 104W, 106W are connected with the feed port 108 which is in the form of a co-axial feed or probe extending generally perpendicular to the axis Z. The two first ridge parts 104W, 106W are connected with a pin 109 (not clearly illustrated), which may be part of the port 108 in FIG. 1C. Both first ridge parts 104W, 106W extend linearly along the axis Z and they have a generally constant thickness $W_0$. The two first ridge parts 104W, 106W are directly opposite each other, with a small, constant gap G in between, as shown in FIG. 1C. Now referring to FIGS. 1A and 1C, the two second ridge parts 104A, 106A each includes two sections, a slightly twisted transition section 104AT, 106AT extending from the first ridge part 104W, 106W and a helical section 104AR, 106AR extending from the transition section 104AT, 106AT. The two transition sections 104AT, 106AT are generally opposite each other, with a gradually widening gap between them (extending away from the first ridge part 104W, 106W along axis Z). The transition sections 104AT, 106AT are arranged to modulate or facilitate conversion of linearly polarized signal to circularly polarized signal (when the antenna 100 transmits signal to environment) and modulate or facilitate conversion of circularly polarized signal to linearly polarized signal (when the antenna 100 receives signal from environment). The two helical sections 104AR, 106AR are arranged to turn anti-clockwise, for about 3 turns, in an interleaved manner, similar to the general form of a double helix. The pitches of each of the two helical sections 104AR, 106AR are generally constant, and the pitches of the two helical sections 104AR, 106AR are generally the same. The helical sections 104AR, 106AR have a reduced, generally constant thickness W1 compared to the thickness W0 of the first ridge parts. As illustrated in FIG. 1B, the helical sections 104AR, 106AR provide rotational symmetry of order 2 in this embodiment. As the helical sections 104AR, 106AR are mounted on the frusto-conical flared housing part 102A, the perimeter of the helical sections 104AR, 106AR generally increases away from the first ridge part 104W, 106W. The helical sections 104AR, 106AR are arranged for communicating (transmitting or receiving or both) a circularly polarized signal.

In the embodiments of FIGS. 1A to 1D, the generally cylindrical housing part 102W and the first ridge parts 104W, 106W of the two ridges 104, 106 together form the waveguide portion 100W, while the frusto-conical flared housing part 102A and the second ridge parts 104A, 106A of the two ridges 104, 106 together form the antenna portion 100A. More specifically, the part of the frusto-conical flared housing part 102A and the transition sections 104AT, 106AT of the second ridge parts 104A, 106A of the two ridges 104, 106 together form the transition portion 100AT of the antenna portion 100A. The part of the frusto-conical flared housing part 102A and helical sections 104AR, 106AR of the second ridge parts 104A, 106A of the two ridges 104, 106 together form a radiating (if transmit) or receiving (if receive) portion 100AR of the antenna portion 100A.

In FIG. 1C, the contour of the second ridge part 104A, 106A of the ridges 104, 106 follows an exponential function or curve. Specifically, the contour follows the equation of $y=ae^{bz}$, $a=G/2$ and $b=\ln(D_1/G)/(L_0-L_1-L_2)$. The various parameters of the horn antenna 100 labelled in FIGS. 1C and 1D have been optimized for -band (8 GHz to 12 GHz) operation. The optimized values of these parameters are listed in Table I.

TABLE I

OPTIMIZED VALUES OF ANTENNA DESIGN PARAMETERS

| Parameter | Value | Parameter | Value | Parameter | Value |
|---|---|---|---|---|---|
| $L_0$ | 275 mm | $W_0$ | 5 mm | α | 810° |
| $L_1$ | 11.45 mm | $W_L$ | 2 mm | G | 1 mm |
| $L_2$ | 18.55 mm | $D_L$ | 62 mm | t | 2 mm |
| $L_3$ | 70 mm | $D_S$ | 24 mm | | |

Figure 2B:
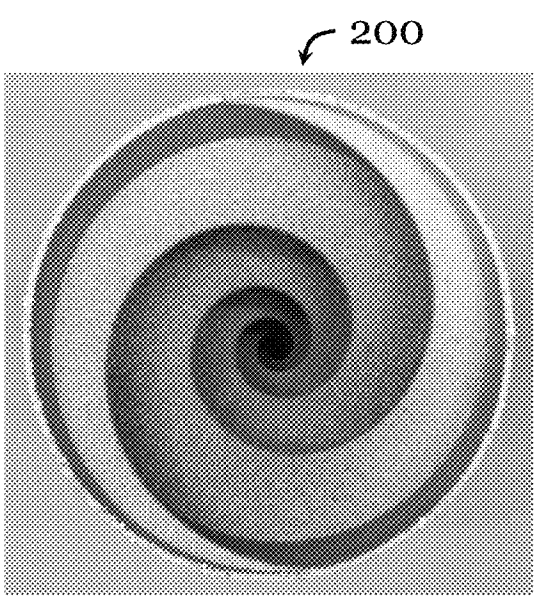
FIG. 2B is a picture showing a front view of the horn antenna of FIG. 2A.
Figure 2A:
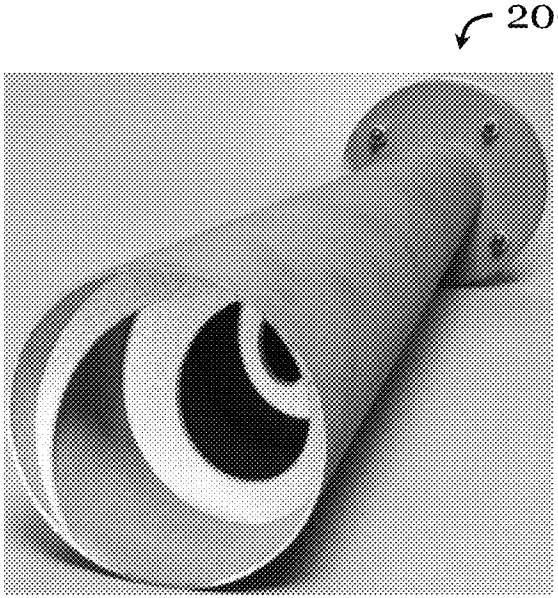
FIG. 2A is a picture showing a perspective view of a horn antenna fabricated based on the horn antenna of FIG. 1A in one embodiment of the invention.

FIGS. 2A and 2B show a prototype of a horn antenna 200 fabricated based on the horn antenna 100 of FIG. 1A and the optimized design parameters of Table I. The horn antenna 200 is particularly adapted for operation in the X-band (8 GHz to 12 GHz). The horn antenna 200 was designed and drawn up using CST Microwave Studio of Dassault Systémes®. An electronic drawing file or computer model of the antenna 200 was created. The electronic drawing file was then used by an existing 3D printer, loaded with the electronic drawing file, to 3D-print the horn antenna 200. The materials used in the printing were aluminium-alloy ($ASi_{10}Mg$).

Various tests and experiments have been performed on the fabricated antenna 200. Specifically, the voltage standing wave ratio (VSWR) of the antenna 200 was measured with an HP8510C vector network analyzer manufactured by Hewlett Packard®; the radiation field, antenna gain, and total efficiency (also considered mismatch) of the antenna 200 were measured with a Satimo Starlab near-field measurement system.

Figure 3:
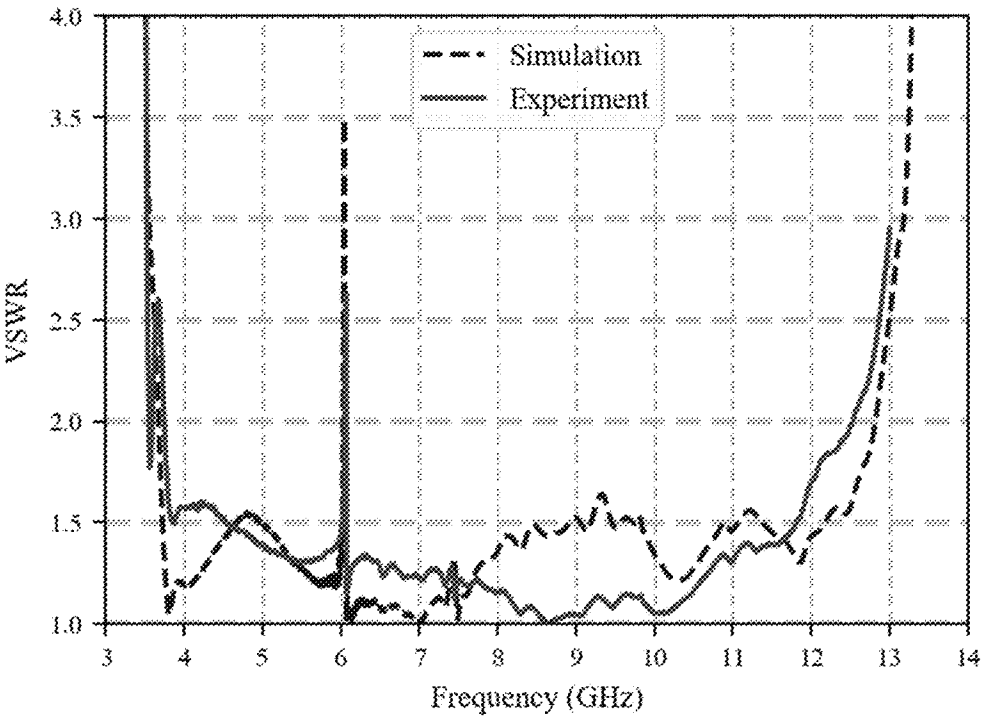
FIG. 3 is a graph showing measured and simulated voltage-standing wave ratio (VSWR) of the horn antenna of FIG. 2A at different frequencies (GHz)
Figure 4:
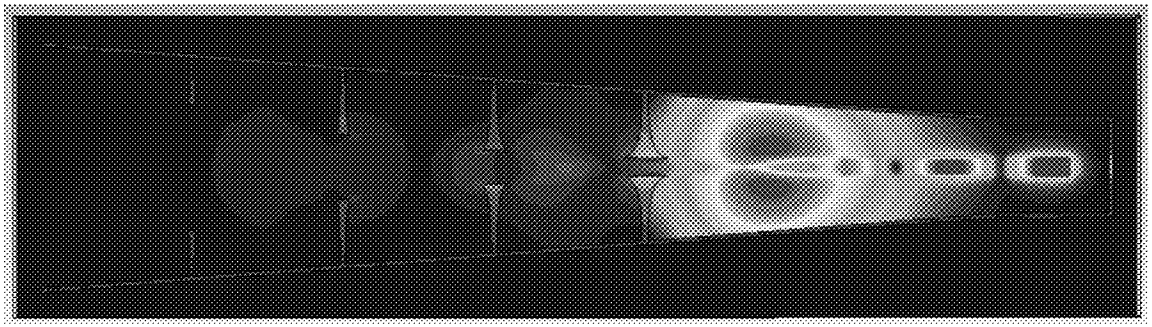
FIG. 4 is a plot (top view) showing a simulated E-field of the horn antenna of FIG. 2A.

FIG. 3 shows the measured and simulated VSWRs of the horn antenna 200 at different frequencies. As seen from FIG. 3, the antenna 200 can be matched satisfactorily in the ultra-wide frequency range. From about 4 GHz to 12.5 GHz, the VSWR of the antenna 200 is less than 2, except for the measured and simulated sharp spikes at 6.06 GHz and 6.04 GHz, respectively. The measured and simulated impedance bandwidths (VSWR<2) are 69% (6.07 GHz to 12.53 GHz) and 72% (6.056 GHz to 12.818 GHz), respectively. The sharp spikes at 6.06 GHz and 6.04 GHz in the graph of FIG. 3 is found to be caused by a trapped mode inside the transition section of the antenna portion, which is also a common phenomenon for an orthogonal mode transducer (OMT). FIG. 4 shows the simulated E-field of the antenna 200 at 6.04 GHz. It shows the trapping of the wave in the transition section of the antenna portion. It should be noted that as the spike is located beyond the X-band (8 GHz to 12 GHz) and it does not affect X-band operation.

Figure 5:
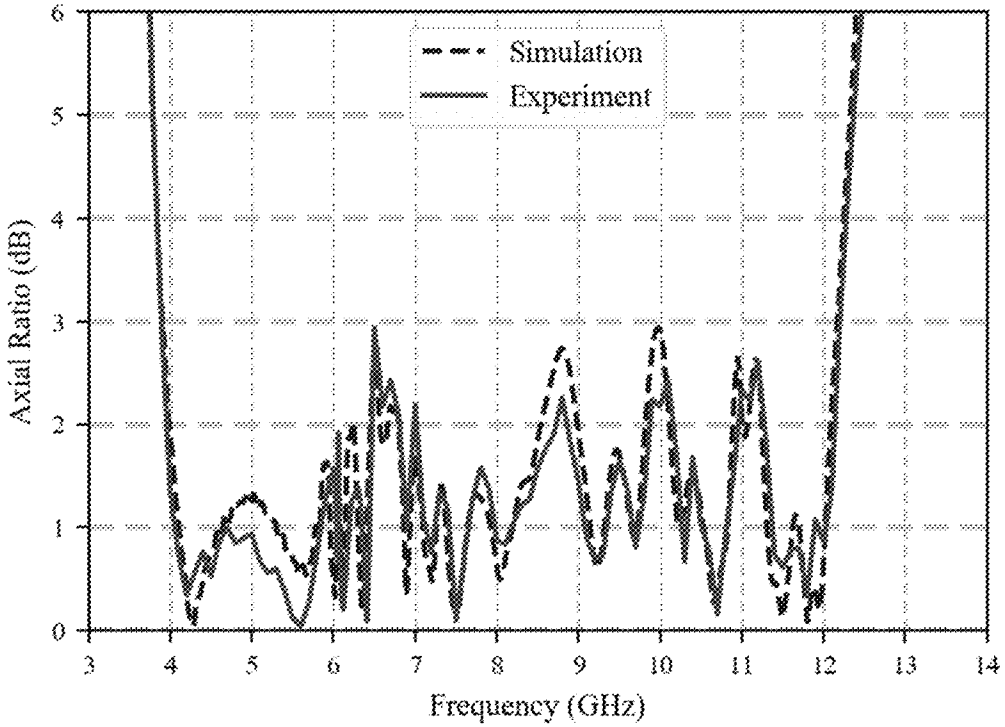
FIG. 5 is a graph showing measured and simulated axial ratio of the horn antenna of FIG. 2A at different frequencies (GHz)

FIG. 5 shows the measured and simulated boresight axial ratios (ARs) of the horn antenna 200. As shown in FIG. 5, the measured and simulated 3-dB AR bandwidths are 103% (3.91 GHz to 12.17 GHz) and 102% (3.95 GHz to 12.16 GHz), respectively. This wideband characteristic is because of the helical ridge parts/structure that can support a non-resonant travelling wave mode insensitive to frequency. By combining the VSWR and AR bandwidths, the measured and simulated overlapping bandwidths are 67% (6.07 GHz to 12.17 GHz) and 67% (6.056 GHz to 12.16 GHz), respectively. It should be noted that in FIG. 5 no spikes is observed from the AR, even though the data was densely sampled at an interval of 10 MHz around the trapped mode. This shows that the trapped mode has negligible or no effect on polarization conversion.

Figure 6:
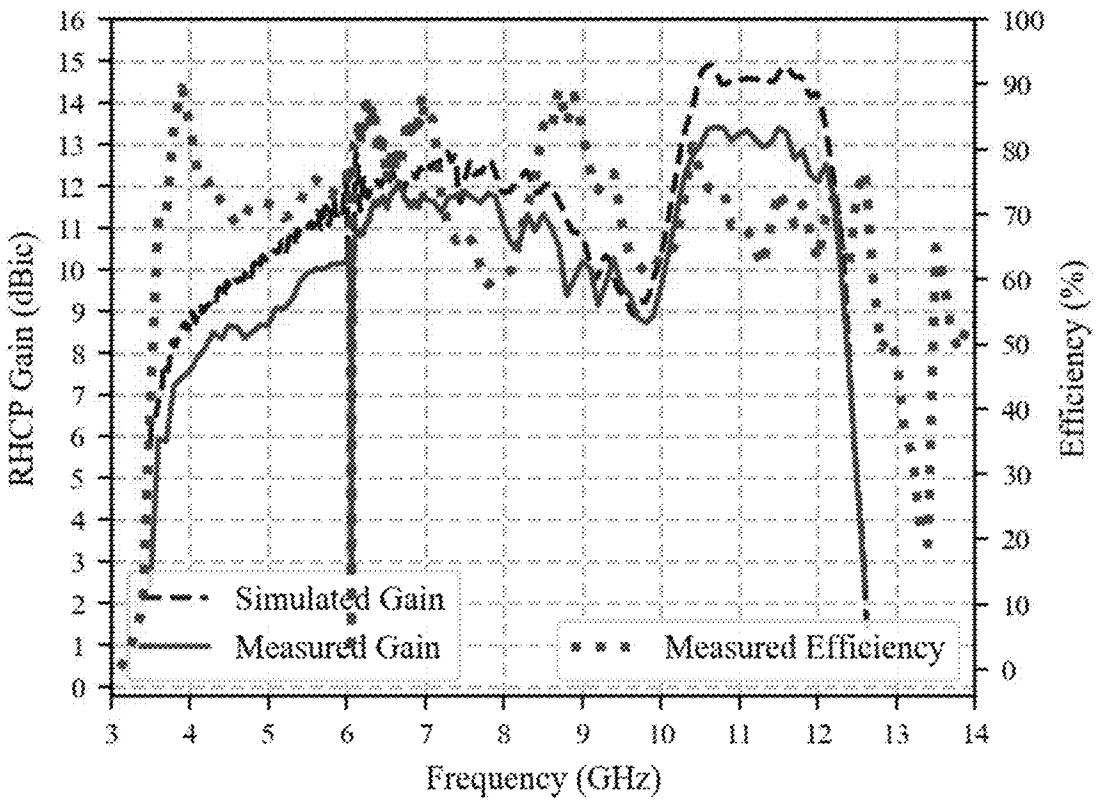
FIG. 6 is a graph showing measured and simulated Right Hand Circular Polarization (RHCP) ratio and measured efficiency of the horn antenna of FIG. 2A at different frequencies (GHz)

FIG. 6 shows the measured and simulated realized antenna gains in the boresight direction. A reasonable agreement between the measured and simulated results is observed. As shown in FIG. 6, the measured gain varies between 8.7 d Bic and 13.4 d Bic over the X-band. The measured gain is lower than the simulated gain due to experimental imperfections and tolerances, which was expected. With reference to FIG. 6, the gain has a spike at 6.06 GHz, where the gain substantially drops from about 10 d Bic to about 3d Bic due to strong mismatch at the spike frequency. FIG. 6 also shows the measured total antenna efficient that has included mismatch. As shown, the measured total efficiency is between 59% and 89%. The fact that the antenna 200 was 3D-printed with metallic particles and yet can still achieve a measured efficiency of 89% demonstrates the robustness of the design. Again, a spike can be observed at 6.06 GHz, where the efficiency dramatically decreases from 70% to 4%.

Figure 7A:
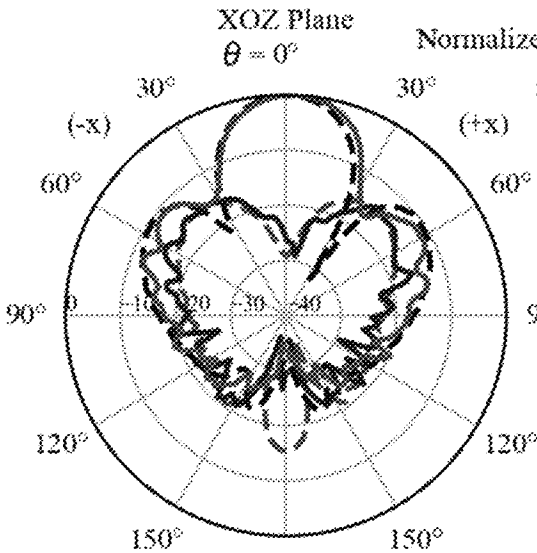
FIG. 7A is a plot showing measured and simulated radiation patterns of the horn antenna of FIG. 2A in the XOZ plane at 8 GHz.
Figure 7B:
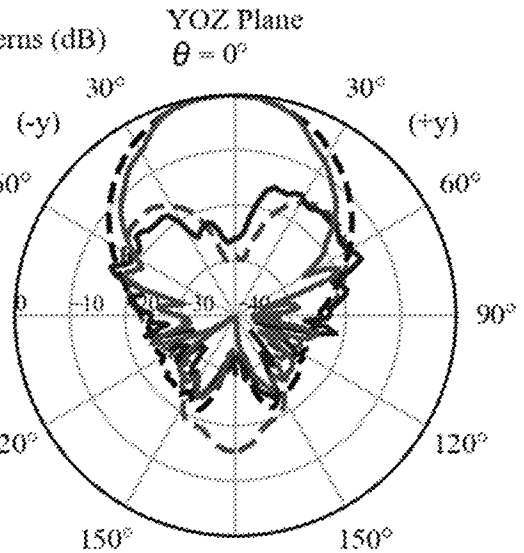
FIG. 7B is a plot showing measured and simulated radiation patterns of the horn antenna of FIG. 2A in the YOZ plane at 8 GHz.
Figure 8A:
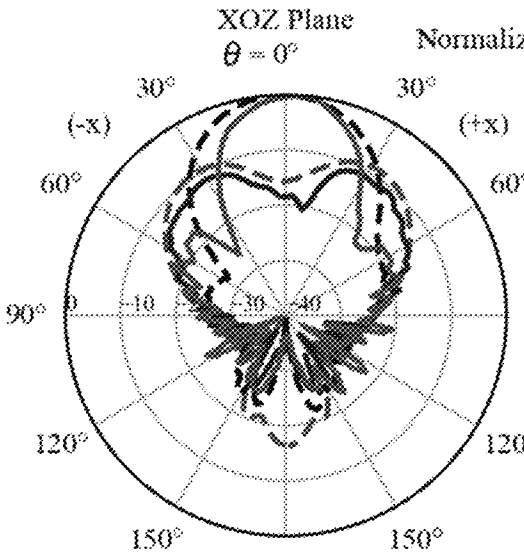
FIG. 8A is a plot showing measured and simulated radiation patterns of the horn antenna of FIG. 2A in the XOZ plane at 10 GHz.
Figure 8B:
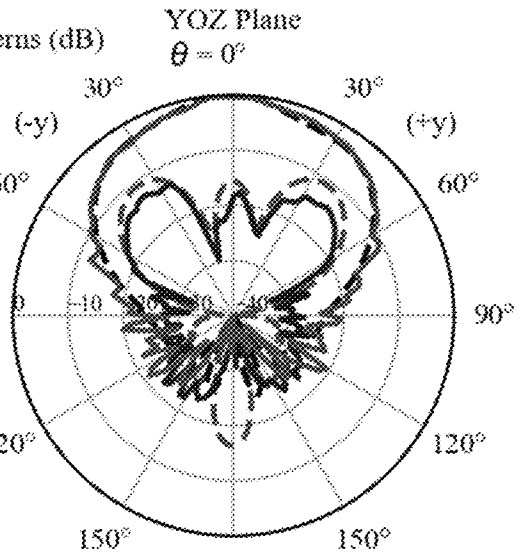
FIG. 8B is a plot showing measured and simulated radiation patterns of the horn antenna of FIG. 2A in the YOZ plane at 10 GHz.
Figure 9A:
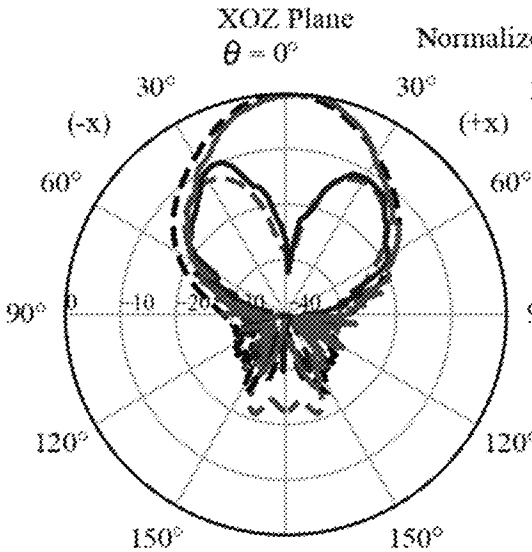
FIG. 9A is a plot showing measured and simulated radiation patterns of the horn antenna of FIG. 2A in the XOZ plane at 12 GHz.
Figure 9B:
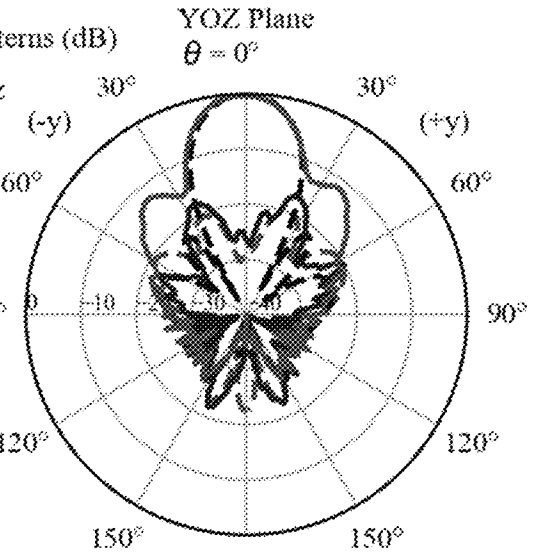
FIG. 9B is a plot showing measured and simulated radiation patterns of the horn antenna of FIG. 2A in the YOZ plane at 12 GHz.

FIGS. 7A and 7B show the measured and simulated radiation patterns of the horn antenna 200 in the XOZ plane and YOZ plane respectively, at 8 GHz. FIGS. 8A and 8B show the measured and simulated radiation patterns of the horn antenna 200 in the XOZ plane and YOZ plane respectively, at 10 GHz. FIGS. 9A and 9B show the measured and simulated radiation patterns of the horn antenna 200 in the XOZ plane and YOZ plane respectively, at 12 GHz. As see from FIGS. 7A to 9B, the cross polarized fields are relatively strong at 10 GHz. Also, the main lobe of the YOZ plane has a relatively wide beam-width at 10 GHz. This explains the local minimum of the gain in FIG. 6 at around this frequency. Table II below summarizes the measured and simulated half-power beam-widths (HPBWs) in the φ=0° and φ=90° planes.

TABLE II

MEASURED AND SIMULATED HPBWS IN XOZ AND YOZ PLANES ACROSS OPERATING BAND

| | Simulation | | Measurement | |
|---|---|---|---|---|
| Frequency (GHz) | HPBW (φ = 0°) | HPBW (φ = 90°) | HPBW (φ = 0°) | HPBW (φ = 90°) |
| 7 | 37° | 46° | 37° | 48° |
| 8 | 28° | 47° | 28° | 39° |
| 9 | 31° | 30° | 39° | 25° |
| 10 | 38° | 52° | 25° | 62° |
| 11 | 27° | 29° | 25° | 25° |
| 12 | 34° | 22° | 34° | 22° |

Figure 10:
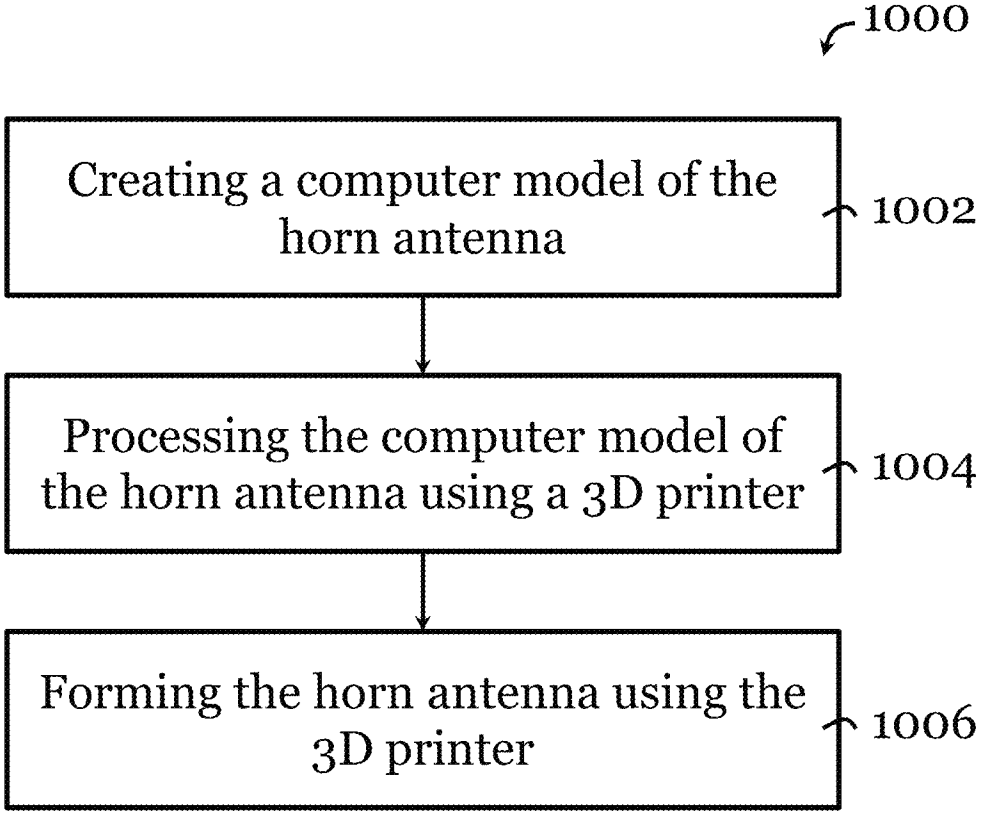
FIG. 10 is a method for making a horn antenna of FIG. 2A in one embodiment of the invention.

FIG. 10 shows a method 1000 for making the antenna of FIG. 2A in one embodiment of the invention. The method 1000 includes, in step 1002, creating a computer model of the horn antenna. The creation may include determining the dimensions and parameters of the antenna. The creation may be performed by a processor of a computing device. Then, in step 1004, the computer model is processed by a 3D printer (either integrated with a processor or connected with an electrical device with a processor). The 3D printer then 3D prints the horn antenna based on the processed computer model of the antenna, as in step 1006. The computer model may be a CAD drawing. The material used by the 3D printer may be a metallic material, a plastic material, etc. The materials may be extruded by the 3D printer. As such, in one example, the antenna portion and the waveguide portion of the antenna 200 may be additively manufactured together, e.g., 3D printed using a 3D printer.

The horn antennas of the above embodiments are particularly suitable for use in satellite communication, radar, and radio astronomy, where circular polarization is desired to avoid polarization mismatch. The horn antennas may also be used as standard reference antenna in an antenna test chamber or electromagnetic compatibility (EMC) chamber.

The above embodiments of the horn antennas provide various advantages. First, the horn antenna has a simple structure with an integrated polarization converter (e.g., the helical ridges). The single feed makes the structure simple and requires only one feeding cable to operate. The use of metal ensures a relatively high radiation efficiency. The horn antenna can cover an octave operating bandwidth, a very wide operating bandwidth. The impedance matching and axial ratio of the antenna can be tuned separately. The main beam can be generally fixed in the boresight direction. The rotation symmetry of the helical ridges facilitates generation of a symmetrical radiation pattern and reduces cross polarization. The antenna can be made simply and cost effectively, e.g., using additive manufacturing techniques.

It will be appreciated by persons skilled in the art that numerous variations and/or modifications may be made to the invention as shown in the specific embodiments. The described embodiments of the invention should therefore be considered in all respects as illustrative, not restrictive.

For example, in some other embodiments, the horn antenna, in particular the housing and the ridge(s), can take shapes or forms or dimensions different from illustrated, so long as the resulting structure can provide the antenna portion and the waveguide portion. The horn antenna, in particular the housing and the ridge(s), can be made using additive manufacturing or alternatively by assembling separate antenna components. The horn antenna preferably has a single feed, but can be multiple feeds in other embodiments. The feed of the antenna can be any form, not limited to a co-axial cable or port. The horn antenna can operate with different frequency bands, not limited to the X band. The flared part of the antenna can be of any shape, not limited to frusto-conical. The shape of the ridge(s) can be of any shape and dimension, not only limited to exponential. The thickness of the ridge(s) may vary in different embodiments. The number of ridge(s) may vary in different embodiments. The ridges may not form rotation symmetry or may form rotation symmetry of higher order. Multiple ones of the horn antennas can be grouped together to form or formed tougher as an antenna array. The section of the horn antenna with the helical ridges (including the housing) can be implemented as a stand-alone part separated from the rest of the antenna, e.g., as an adapter. The horn antenna may be a transmit-only antenna, a receive-only antenna, or a transceiver antenna.

The invention claimed is:

1. A horn antenna comprising:

a body defining a waveguide portion with a feed port; and an antenna portion operably connected with the waveguide portion and arranged to receive a linearly polarized signal from the waveguide portion and to convert the received linearly polarized signal to a circularly polarized signal for transmission; wherein the body comprises:

an elongated housing extending generally along a longitudinal axis, the elongated housing includes a non-flared housing part and a flared housing part; and one or more ridges arranged on and extending along an inner surface of the elongated housing; wherein each of the one or more ridges include a first ridge part arranged on and extending along an inner surface of the non-flared housing part; and a second ridge part arranged on and extending along an inner surface of the flared housing part, the second ridge part comprises a helical section for communicating a circularly polarized signal; wherein the non-flared housing part and the first ridge part of the one or more ridges form the waveguide portion; and wherein the flared housing part and the second ridge part of the one or more ridges form the antenna portion.

2. The horn antenna of claim 1, wherein the antenna portion is further arranged to convert a circularly polarized signal received to a linearly polarized signal and to transmit the linearly polarized signal to the waveguide portion.

3. The horn antenna of claim 1, wherein the antenna portion comprises a transition portion for modulating the linearly polarized signal received from the waveguide portion.

4. The horn antenna of claim 1, wherein the feed port is the only feed port of the horn antenna such that the horn antenna is a single-feed horn antenna.

5. The horn antenna of claim 1, wherein the antenna portion and the waveguide portion are unitary.

6. The horn antenna of claim 1, wherein the antenna portion and the waveguide portion are metallic.

7. The horn antenna of claim 1, wherein the antenna portion is an additively manufactured antenna.

8. The horn antenna of claim 1, wherein the waveguide portion is an additively manufactured waveguide.

9. The horn antenna of claim 1, wherein the horn antenna is adapted for operation in X-Band.

10. The horn antenna of claim 1, wherein the first ridge part has a first thickness and the helical section has a second thickness smaller than the first thickness.

11. The horn antenna of claim 1, wherein the second ridge part further comprises:

a transition section connected between the helical section and the waveguide portion.

12. The horn antenna of claim 1, wherein the one or more ridges comprises a plurality of ridges.

13. The horn antenna of claim 12, wherein a cross section of the antenna portion is rotationally symmetric.

14. The horn antenna of claim 12, wherein the plurality of ridges comprises a first ridge and a second ridge, the first ridge parts of the first ridge and the second ridge are arranged in parallel and opposite to each other.

15. The horn antenna of claim 12, wherein the plurality of ridges comprises a first ridge and a second ridge, the helical sections of the second ridge parts have generally the same pitch.

16. An antenna array comprising a plurality of the horn antennas of claim 1.

17. A communication device comprising one or more of the horn antennas of claim 1.

* * * * *